US005653061A

United States Patent [19]

Hiner

[11] Patent Number: 5,653,061

[45] Date of Patent: Aug. 5, 1997

[54] ACCESS PANEL

[75] Inventor: Larry D. Hiner, Tulsa, Okla.

[73] Assignee: Diversified Plastics, Inc., Sand Springs, Okla.

[21] Appl. No.: 583,712

[22] Filed: Jan. 5, 1996

[51] Int. Cl.[6] ..... E06B 3/44

[52] U.S. Cl. ..... 49/463; 49/464

[58] Field of Search ..... 49/463, 464; 52/220.1, 52/220.8; 40/611, 768, 620

[56] References Cited

U.S. PATENT DOCUMENTS

| | | | |
|---|---|---|---|
| 156,540 | 12/1874 | Conner | 49/463 |
| 1,798,564 | 3/1931 | Timberlake | 40/611 |
| 1,804,741 | 5/1931 | Butzbach . | |
| 1,843,883 | 2/1932 | Pogue | 40/611 |
| 1,994,203 | 3/1935 | Waldman | 20/4 |
| 2,581,762 | 1/1952 | Hesse | 40/611 |
| 2,817,914 | 12/1957 | Rosen | 40/620 |
| 3,286,405 | 11/1966 | Schembri | 49/463 |
| 3,381,416 | 5/1968 | De Torres | 49/464 |
| 3,491,486 | 1/1970 | Caruth | 49/463 |
| 3,745,704 | 7/1973 | Covington | 49/57 |
| 3,792,551 | 2/1974 | Hallas | 49/463 |
| 3,861,081 | 1/1975 | Maskell | 49/463 |
| 4,730,413 | 3/1988 | Henry | 49/463 |
| 4,776,484 | 10/1988 | Hansen | 220/345 |
| 4,890,418 | 1/1990 | Sachs | 49/463 |
| 4,970,836 | 11/1990 | Brown | 52/221 |
| 4,972,634 | 11/1990 | Dresden | 52/69 |
| 5,067,278 | 11/1991 | Lyons | 49/463 |
| 5,123,211 | 6/1992 | Schlicht et al | 52/202 |
| 5,283,995 | 2/1994 | Richter | 52/202 |
| 5,347,775 | 9/1994 | Santos | 52/202 |

*Primary Examiner*—Kenneth J. Dorner
*Assistant Examiner*—Curtis Cohen
*Attorney, Agent, or Firm*—Head, Johnson & Kachigian

[57] ABSTRACT

An access panel for mounting in a wall having an opening therethrough for enabling access to the wall opening, the panel having a frame having an integral flange defined by planar top, bottom and opposed side wall flange portions, the frame being further defined by an integral inset portion in a plane spaced rearwardly from the plane of the flange portions, the inset portion having an opening therethrough, the inset portion providing slide surfaces in a plane spaced from the plane of the flange rearward surfaces, a full width top slot being provided in the inset portion between the opposed side flanges, a shorter length bottom slot being formed in the inset portion between the opposed frame side flange portions, and a planar removable panel slidably receivable in the top slot, the panel having a short-length downwardly extending tang portion that is removably received in the bottom slot when the panel is in the closed position, the panel being removable by upwardly displacing it through the top slot to clear the tang portion from the bottom slot.

8 Claims, 2 Drawing Sheets

ACCESS PANEL

CROSS-REFERENCE TO RELATED APPLICATIONS

This application is not related to any pending patent applications.

CROSS-REFERENCE TO MICROFICHE APPENDIX

This application is not related to any microfiche appendix.

BRIEF SUMMARY OF THE INVENTION

An access panel for mounting in a wall is the subject of this disclosure. The access panel provides access to an opening in the wall and includes a frame having an integral flange. The flange is defined by planar top, bottom and opposed side flange portions each having an interior surface adapted to fit against the wall. The flange is designed to surround an opening in a wall. The frame has an inset portion integral with the flange, the inset portion having a front edge in a plane paralleled to and spaced from the plane of the flange interior surface. The insert portion has a large opening through it which defines the opening provided by the access panel.

A top slot is provided in the opening between the inset portion and the flange top portion. The top slot extends the full width of the inset portion.

The inset portion further has a bottom slot opening provided between the inset portion and the flange bottom portion. The width of the bottom slot opening is less than the spacing between the flange opposed sides.

A planer panel is removably positioned in the frame. The panel has a top, a bottom and opposed side edges. The width between the side edges is greater than the opening through the frame inset portion and slightly less than the spacing between the frame opposed side flange portions. The height of the removable panel from the top to the bottom edges is greater than the spacing between the top and bottom flange portions. The removable panel is slidably received in top slot opening.

The panel has an integral short-length planar tang portion extending from the bottom edge. The tang portion is removably received within the bottom slot. The tang portion, in cooperation with the top slot, holds the panel in a secured position within the frame inset portion when the access panel is closed. The panel is removable by upwardly displacing it through the top slot for a short distance to clear the tang portion from the bottom slot, after which the bottom of the removable panel can be extracted from within the frame inset portion and the panel completely disengaged from the frame by sliding it downwardly until it is clear of the frame top slot.

The frame and panel are preferably formed of rigid plastic, such as ABS plastic. The frame can be secured to a wall with adhesive or with fasteners, such as screws. The frame preferably has beveled edges to give it a flush appearance.

The access panel disclosed herein does not employ any clips, hinges, springs or other ancillary elements. The panel gives the appearance of being flush, although the removable planar panel portion is slightly recessed within the frame.

The access panel can be used to provide access to controls for operation of Jacuzzi's, whirlpools, spas, tubs, showers, water or gas shutoff valves, and so forth.

A better understanding of the invention will be obtained from the following detailed description of the preferred embodiment, taken in conjunction with the attached drawings.

DESCRIPTION OF THE PREFERRED EMBODIMENTS

Figure 2:
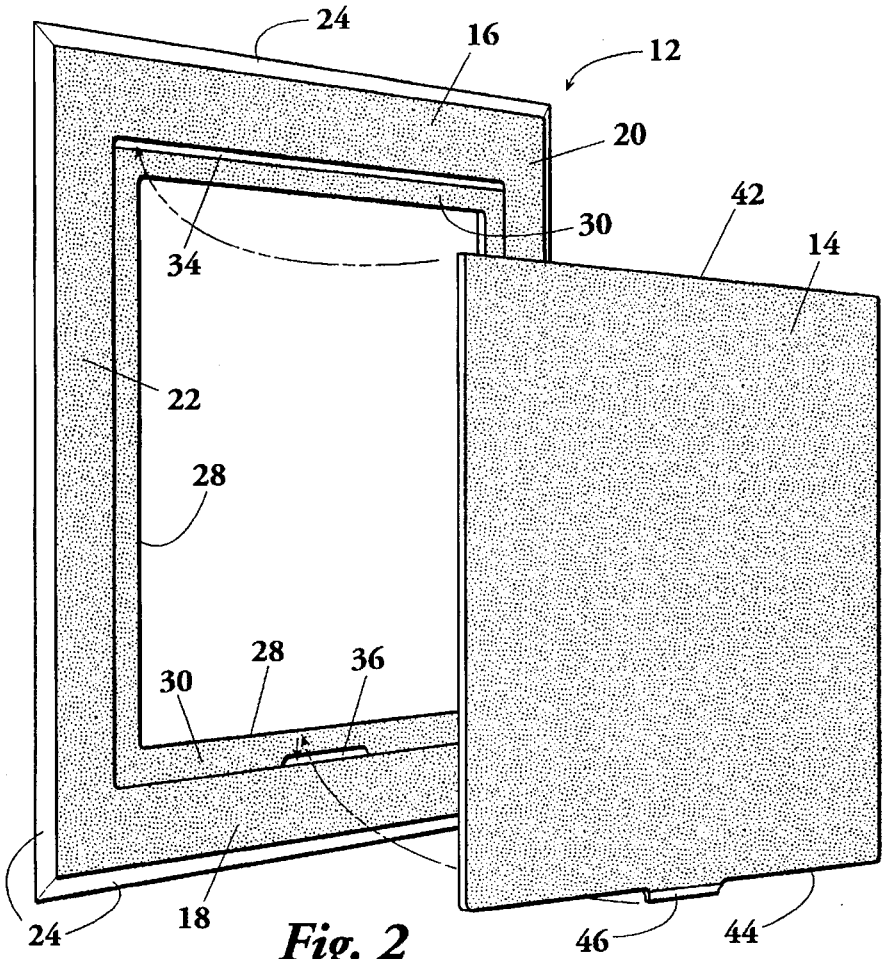
FIG. 2 is an exploded isometric view showing the panel having been removed from the frame portion.
Figure 1:
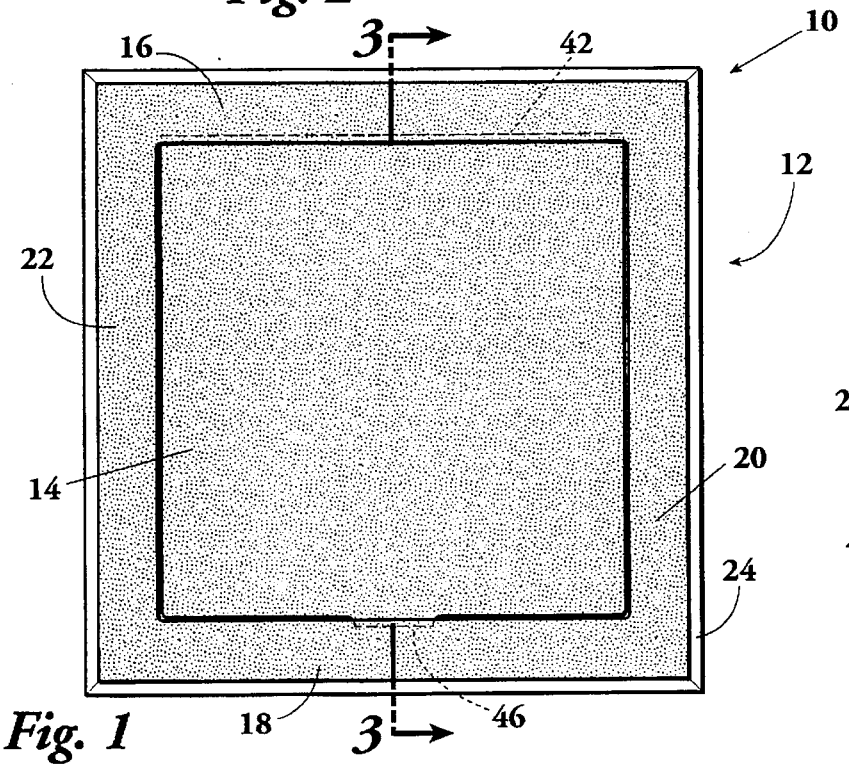
FIG. 1 is an elevational view of the access panel of this invention fully assembled as it would appear when mounted on a wall.
Figure 3:
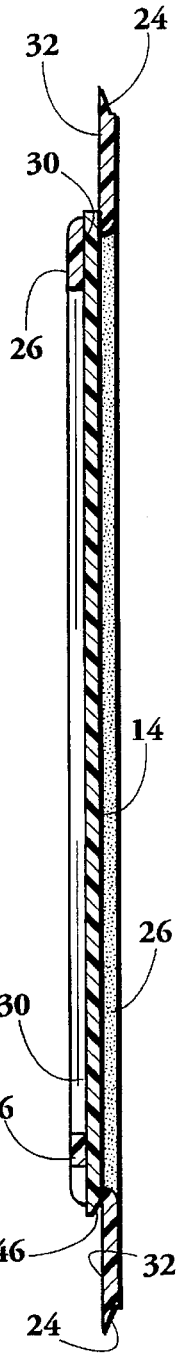
FIG. 3 is a cross-sectional view taken along the line 3—3 of FIG. 1 showing the removable panel in position within the frame.

Referring now to the drawings and first to FIGS. 1, 2 and 3, the basic elements of the invention are illustrated. The access panel of this invention is generally indicated by the numeral 10 and consists of two parts. The first part is a frame 12 and the second part is a removable planar panel 14.

Figure 4:
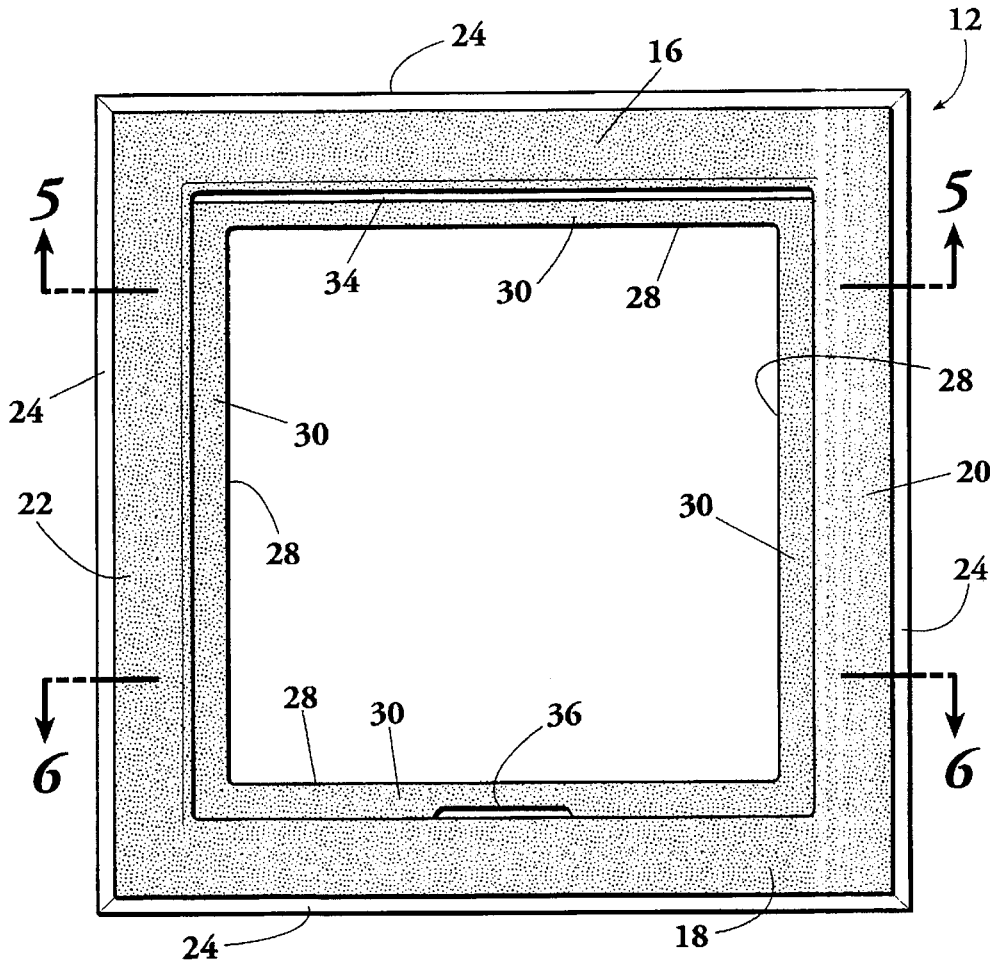
FIG. 4 is an enlarged elevational view of the frame, the removable panel portion not being shown.
Figure 5:
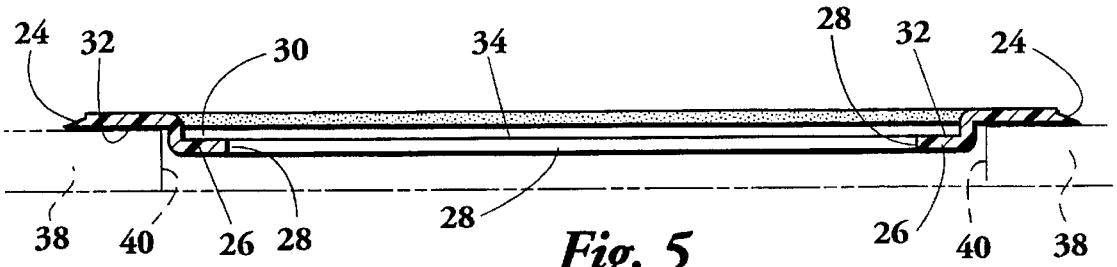
FIG. 5 is a cross-sectional view taken along the line 5—5 of FIG. 4 showing the top slot opening in the frame inset portion.
Figure 6:
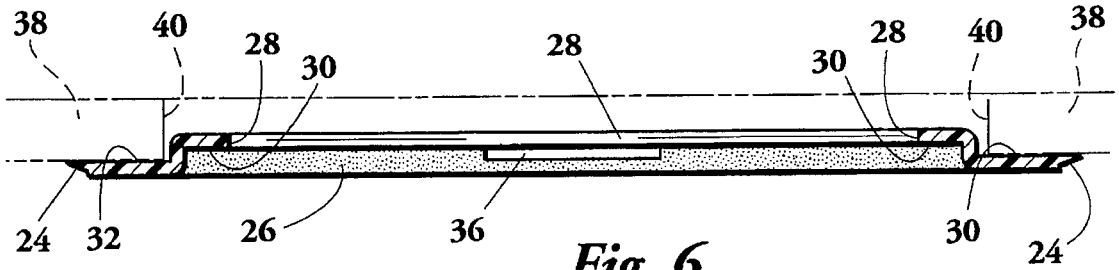
FIG. 6 is a cross-sectional view taken along the line 6—6 of FIG. 4 showing the bottom slot in the frame inset portion.

Referring now to FIGS. 4, 5 and 6, frame 12 is illustrated in detail. Frame 12 includes an integral flange having a top flange 16, an integral bottom flange 18, and integral opposed side flanges 20 and 22. The frame flanges are preferably provided with bevels 24 at their outer edges.

Integrally formed as a part of frame 12 is an inset portion 26. Inset portion 26 has an opening 28 therethrough. In the illustrated arrangement, the opening 28 is square although obviously the opening could be rectangular or circular. Opening 28, however, must be of dimensions that are less than the interior dimensions of the flange portions 16, 18, 20 and 22 so as to provide a slide surface 30 surrounding opening 28.

Inset portion 26 is in a plane that is parallel to and spaced from the plane of the frame flange portions 16, 18, 20 and 22. Specifically, the flange portions have a rearward surface 32 that is in a plane displaced from the plane of the slide surfaces 30 a distance slightly greater than the thickness of removable panel 14. The relative spacing between slide surfaces 30 and the rearward surface 32 of the flanges is best seen in FIG. 3.

Referring again to FIGS. 4, 5 and 6, frame 12 is completed by a top slot 34 formed in inset portion 26. The width of top slot 34 is substantially equal to the spacing between the interior edges of the frame side flanges 20 and 22.

The inset portion is further defined by a bottom slot 36 that is adjacent the frame bottom flange 18 and is of a width less than the spacing between the frame side flanges 20 and 22. As shown in FIGS. 4 and 6, the bottom slot 36 is of a length substantially less than that of top slot 34 and is centrally positioned between flange portions 20 and 22.

FIGS. 5 and 6 show portions of a wall 38, the wall being shown in dotted outline such as typically formed of sheet rock material. Wall 38 has an opening 40 therein. Opening 40 is preferably just slightly larger than the exterior dimensions of the frame inset portion 26. This permits the inset portion to be received within wall opening 40 So that frame flange portions 16, 18, 20 and 22 fit snugly against the exterior surface of wall 38. Wall 38 is not shown in the other figures and is illustrated in FIGS. 5 and 6 only to show how the access panel is used to cover an opening in a wall and to provide access to such opening.

Referring again to FIGS. 1, 2 and 3, the method of operation of the invention is illustrated. FIG. 1 shows the removable panel 14 in closed position with respect to frame 12. As shown in FIG. 1, the closed access panel presents a clean and unobtrusive appearance. The frame and access panel are shown with stippled surfaces to illustrate the preferred embodiment wherein the exterior surfaces of the frame and removable panel are textured to easily accept paint. When the access panel 10, as shown in FIG. 1, is used on a wall and painted the same color as the wall, the access panel blends in and provides a pleasing way to afford an access to an opening in a wall without calling attention to the fact that such access is provided.

Removable panel 14 is installed within frame 12 by inserting the top edge 42 into top slot 34. Removable panel 14 has, as previously described, extending from the removable panel lower edge 44, an integral short-length tang portion 46 that is a width slightly less than the width of bottom slot 36. Tang portion 46 may be slightly inwardly beveled as illustrated. The beveling occurring below the removable panel lower edge 44.

After the removable panel top edge 42 is inserted into top slot 34, the removable panel is slightly upwardly slidably displaced with respect to the frame inset portion, permitting tang portion 46 to enter bottom slot 36. Thereafter, the removable panel 14 is slidably downwardly positioned until the lower edge 44 engages inset portion 26. The removable panel is thus retained within the frame inset portion with the top edge 42 extending slightly above slot 34, the top edge 42 being shown by a dotted line in FIG. 1. The tang portion 46 is indicated by dotted lines in FIG. 1.

To remove the removable panel 14, it is slightly upwardly displaced to remove tang portion 46 from bottom slot 36. Afterwards, the bottom end of the removable panel 14 may be outwardly displaced with respect to the frame and the entire panel then removed by downwardly sliding the removable panel to extract the top portion from slot 34. This then fully exposes opening 40 in wall 38 as shown in FIGS. 5 and 6. More specifically, when the removable panel 14 is removed from the frame, the opening 40 in wall 38 is exposed through the opening 28 formed in inset portion 26.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An access panel for mounting in a wall for enabling access to an opening in the wall, the access panel comprising:

an integral one piece frame having a flange defined by planar top, bottom and opposed side integral flange portions each having an interior surface adapted to fit against a wall, the frame flange portions being adapted to surround an opening in a wall, the frame having an inset portion integral with said flange portion, the inset portion having a front edge in a plane parallel to and spaced from said plane of said flange portion interior surface, the inset portion having an opening therethrough, a top slot opening being provided between said inset portion and said flange top portion extending the full width of said insert portion, and a bottom slot opening being provided between said insert portion and said flange bottom portion, the width of the bottom slot opening being less than the spacing between said flange opposed sides; and a planar removable panel positioned in said frame, the removable panel having a top, a bottom and opposed side edges, the width between the side edges being greater than said opening in said frame inset portion and slightly less than the spacing between said frame opposed side flange portions, the height of the removable panel from said top to said bottom edges being greater than the spacing between said top and bottom flange portions, the removable panel being slideably receivable in said top slot opening, the removable panel having an integral short-length planar tang portion extending from said bottom edge, the tang portion being receivable received within said bottom slot whereby said panel is removably retained in said frame to close said opening in said inset portion.

2. An access panel according to claim 1 wherein said panel tang portion has a beveled lower edge to facilitate inserting said tang portion into said lower slot when said panel is positioned within said frame portion.

3. An access panel for mounting in a wall for enabling access to an opening in the wall, comprising:

an integral one piece frame having a planar peripheral flange portion and an integral inset portion having an opening therethrough, the inset portion being in a plane parallel to and spaced from said frame, a top slot being provided in the inset portion;

a planar panel receivable in said frame and positionable contiguously with said inset portion, the planar panel extending slidably through said top slot, the panel covering said opening in said inset portion; and means to removably retain said panel in said frame.

4. An access panel according to claim 3 wherein said inset portion has a bottom slot therein and wherein said removable panel has an integrally extending tang portion, the tang portion being removably receivable in said bottom slot and providing said means to retain said panel in said frame.

5. An access panel according to claim 4 wherein said tang portion has a lower edge that is beveled to facilitate inserting said tang portion into said lower slot when said panel is positioned in said frame.

6. An access panel according to claim 3 wherein said panel flange portion has outer peripheral edges that are beveled.

7. An access panel according to claim 3 Wherein said frame and said panel are formed of plastic.

8. An access panel according to claim 7 wherein said frame and said panel are formed of plastic having a surface that readily accepts paint.

* * * * *

UNITED STATES PATENT AND TRADEMARK OFFICE

CERTIFICATE OF CORRECTION

PATENT NO. : 5,653,061

DATED : August 5, 1997

INVENTOR(S) : Larry D. HINER

It is certified that error appears in the above-indentified patent and that said Letters Patent is hereby corrected as shown below:

Cover page, [56] References Cited U.S. PATENT DOCUMENTS, between

"1,994,203 3/1935 Waldman ..... 20/4" and

"2,581,762 1/1952 Hesse ..... 40/611"

insert

--2,003,982 6/1935 Swanson ..... 20/56.5--;

and between

"5,283,995 2/1994 Richter ..... 52/202" and

"5,347,775 9/1994 Santos ..... 52/202"

insert

--5,327,682 7/1994 Holtz ..... 49/463--

Column 3, line 2, delete "So" and insert --so--; and

UNITED STATES PATENT AND TRADEMARK OFFICE

CERTIFICATE OF CORRECTION

PATENT NO. : 5,653,061

DATED : August 5, 1997

INVENTOR(S) : Larry D. HINER

It is certified that error appears in the above-indentified patent and that said Letters Patent is hereby corrected as shown below:

Column 4, line 61 (line 1 of claim 7), delete "Wherein" and insert --wherein--.

Signed and Sealed this

Seventh Day of October, 1997

*Attest:*

Bruce Lehman

BRUCE LEHMAN

*Attesting Officer*

*Commissioner of Patents and Trademarks*